US007327549B2

(12) United States Patent
Smith et al.

(10) Patent No.: US 7,327,549 B2
(45) **Date of Patent: *Feb. 5, 2008**

(54) SYSTEMS AND METHODS FOR TARGET IMPACT

(75) Inventors: Patrick W. Smith, Scottsdale, AZ (US); Magne H. Nerheim, Paradise Valley, AZ (US)

(73) Assignee: TASER International, Inc., Scottsdale, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/457,046

(22) Filed: Jul. 12, 2006

(65) Prior Publication Data

US 2006/0279898 A1 Dec. 14, 2006

Related U.S. Application Data

(63) Continuation of application No. 10/750,374, filed on Dec. 31, 2003, which is a continuation-in-part of application No. 10/714,572, filed on Nov. 13, 2003, now Pat. No. 7,042,696.

(60) Provisional application No. 60/509,480, filed on Oct. 8, 2003, provisional application No. 60/509,577, filed on Oct. 7, 2003.

(51) Int. Cl.
*F41B 15/04* (2006.01)
*F42B 10/16* (2006.01)

(52) U.S. Cl. ..... 361/232; 361/235; 102/502

(58) Field of Classification Search ..... 361/232, 361/235, 230; 102/502
See application file for complete search history.

(56) References Cited

U.S. PATENT DOCUMENTS

| | | | | | |
|---|---|---|---|---|---|
| 4,253,132 | A | * | 2/1981 | Cover | 361/232 |
| 5,193,048 | A | * | 3/1993 | Kaufman et al. | 361/232 |
| 5,437,501 | A | * | 8/1995 | Kohno et al. | 303/116.2 |
| 5,457,597 | A | * | 10/1995 | Rothschild | 361/232 |
| 5,473,501 | A | | 12/1995 | Claypool | |
| 5,654,867 | A | * | 8/1997 | Murray | 361/232 |
| 5,698,815 | A | * | 12/1997 | Ragner | 102/502 |
| 5,750,918 | A | * | 5/1998 | Mangolds et al. | 102/502 |
| 5,786,546 | A | * | 7/1998 | Simson | 102/438 |
| 5,831,199 | A | * | 11/1998 | McNulty et al. | 89/1.11 |
| 5,841,622 | A | * | 11/1998 | McNulty, Jr. | 361/232 |
| 5,855,426 | A | * | 1/1999 | Burns | 362/253 |
| 5,898,125 | A | * | 4/1999 | Mangolds et al. | 102/439 |
| 5,962,806 | A | * | 10/1999 | Coakley et al. | 102/502 |
| 5,988,036 | A | * | 11/1999 | Mangolds et al. | 86/1.1 |
| 6,053,088 | A | * | 4/2000 | McNulty, Jr. | 89/1.11 |

(Continued)

OTHER PUBLICATIONS

John M. Kenny, Hurnan Effects Advisory Panel Report of Findings: Sticky Shocker Assessment, PennState, Applied Research Laboratory, Jul. 29, 1999, 67 pages.

(Continued)

*Primary Examiner*—Michael Sherry
*Assistant Examiner*—Zeev Kitov
(74) *Attorney, Agent, or Firm*—William R. Bachand

(57) ABSTRACT

An apparatus for impact with a target includes electrodes deployed after contact is made between the apparatus and the target. Spacing of deployed electrodes may be more accurate and/or more repeatable for more effective delivery of an immobilizing stimulus signal.

31 Claims, 10 Drawing Sheets

U.S. PATENT DOCUMENTS

| | | | | |
|---|---|---|---|---|
| 6,269,726 | B1 * | 8/2001 | McNulty, Sr. | 89/1.11 |
| 6,381,894 | B1 * | 5/2002 | Murphy | 42/77 |
| 6,543,364 | B2 * | 4/2003 | Wes et al. | 102/490 |
| 6,553,913 | B1 * | 4/2003 | Wardlaw | 102/501 |
| 6,575,073 | B2 * | 6/2003 | McNulty et al. | 89/1.11 |
| 6,636,412 | B2 * | 10/2003 | Smith | 361/232 |
| 6,640,722 | B2 * | 11/2003 | Stogermuller | 102/439 |
| 6,877,434 | B1 | 4/2005 | McNulty | |
| 6,880,466 | B2 | 4/2005 | Carman | |
| 7,042,696 | B2 * | 5/2006 | Smith et al. | 361/232 |

OTHER PUBLICATIONS

Jaycor, Executive Summary, Excerpt from Jaycor Report. Nov. 2004, 33 pages, Jaycor. San Diego, CA.

Edward Vasel, Sticky Shocker, J203-98-0007/2990, 7 pages, Jaycor. San Diego, CA.

* cited by examiner

SYSTEMS AND METHODS FOR TARGET IMPACT

CROSS-REFERENCE TO RELATED APPLICATIONS

This application is a continuation of and claims priority under 35 U.S.C. § 120 from U.S. patent application Ser. No. 10/750,374 filed Dec. 31, 2003 by Patrick W. Smith et al., incorporated herein by reference; which is a continuation in part of U.S. patent application Ser. No. 10/714,572 filed Nov. 13, 2003 by Patrick Smith et al., now U.S. Pat. No. 7,042,696 incorporated herein by reference; which claims priority under 35 U.S.C. § 119(e) to U.S. application Ser. No. 60/509,577 filed Oct. 7, 2003 by Rick Smith et al., incorporated herein by reference; and to U.S. application Ser. No. 60/509,480 filed on Oct. 8, 2003 by Rick Smith et al., incorporated herein by reference.

GOVERNMENT LICENSE RIGHTS

The present invention may have been, in part, derived in connection with U.S. Government sponsored research. Accordingly, the U.S. Government has a paid-up license in this invention and the right in limited circumstances to require the patent owner to license others on reasonable terms as provided for by the terms of contract No. N00014-02-C-0059 awarded by the Office of Naval Research.

BACKGROUND OF THE INVENTION

Embodiments of the present invention generally relate to systems and methods using an electrified projectile for reducing mobility in a person or animal.

Weapons that deliver electrified projectiles have been used for self defense and law enforcement where the target struck by the projectile is a human being or an animal. One conventional class of such weapons includes conducted energy weapons of the type described in U.S. Pat. Nos. 3,803,463 and 4,253,132 to Cover. A conducted energy weapon typically fires two projectiles from a handheld device to a range of about 15 feet to deliver a stimulus signal to the target. The projectiles remain tethered to a power supply in the handheld device by two fine, insulated wires. Tethered projectiles are also called darts.

A stimulus signal comprising a series of relatively high voltage pulses are delivered through the wires and into the target, causing pain in the target. At the time that the stimulus signal is delivered, a high impedance gap (e.g., air or clothing) may exist between electrodes of the projectiles and the target's conductive tissue. The stimulus signal conventionally includes a relatively high voltage (e.g., about 50,000 volts) to ionize a pathway across such a gap of up to 2 inches. Consequently, the stimulus signal may be conducted through the target's tissue without penetration of the projectile into the tissue. Effectiveness of a stimulus signal of the type described by Cover is limited. For example, tests showed that most human targets who were given a physical motor task to perform during or after being struck with the projectiles and subjected to a relatively high voltage (e.g., fight against the person armed with the weapon) could accomplish the task.

Conventional conducted energy weapons that use a gunpowder propellant have limited application. These weapons are classified as firearms and are subject to heavy restrictions in the United States, severely limiting their marketability.

Other conventional energy weapons known as stun guns omit the projectiles and deliver essentially the same stimulus signal to a target when the target is in close proximity to the weapon. These weapons have limited application because close proximity typically decreases the safety of the person armed with the weapon.

Another conventional conducted energy weapon, not classified as a firearm, uses compressed gas to propel the projectile as described for example in U.S. Pat. No. 5,078,117 to Cover. This propulsion system uses a relatively small primer that is detonated by an electric charge in the weapon. The detonation forces a cylinder of compressed gas such as nitrogen onto a puncturing device to release an amount of compressed nitrogen that propels the projectile out of the weapon.

More recently, a relatively higher energy waveform has been used in the conducted energy weapons discussed above. This waveform was developed from studies using anesthetized pigs to measure the muscular response of a mammalian subject to an energy weapon's stimulation. Devices using the higher energy waveform are called Electro-Muscular Disruption (EMD) devices and are of the type generally described in U.S. patent application Ser. No. 10/016,082 to Patrick Smith, filed Dec. 12, 2001, incorporated herein by this reference. An EMD waveform applied to an animal's skeletal muscle typically causes that skeletal muscle to violently contract. The EMD waveform apparently overrides the target's nervous system's muscular control, causing involuntary lockup of the skeletal muscle, and may result in complete immobilization of the target. Unfortunately, the relatively higher energy EMD waveform is generally produced from a higher power capability energy source. For instance, a weapon of this type may include 8 AA size 1.5 volt batteries, a large capacity capacitor, and transformers to generate a 26-watt EMD output to a tethered projectile (e.g., a dart).

A two pulse waveform of the type described in U.S. patent application Ser. No. 10/447,447 to Magne Nerheim filed Feb. 11, 2003, provides a relatively high voltage, low amperage pulse (to form an arc through a gap as discussed above) followed by a relatively lower voltage, higher amperage pulse (to stimulate the target). Effects on skeletal muscles may be achieved with 80% less power than EMD waveforms, discussed above.

Conventional conducted energy weapons have limited range to achieve an effective separation of two electrodes to stimulate the target by an electric current passing between the electrodes. In one conventional weapon, two projectiles, each with an electrode, are fired from the same cartridge at an 8-degree angle of separation. The upper projectile is fired along the line of sight from the weapon. The lower projectile is fired at an 8-degree downward angle. This angle separates the electrodes during flight. At a range of 21 feet, the bottom electrode will contact the target about 3 feet below the top electrode's point of contact.

A consistent electrode separation regardless of the distance from the handheld device to the target is provided in a system as described in U.S. Pat. No. 6,575,073 to McNulty. There, a larger projectile carrying a first electrode includes a range sensor. At a sensed distance from the target, the larger projectile fires a smaller projectile carrying the second electrode. Higher cost and lower reliability result. A range sensing system could malfunction by having a narrow field of view, for example, where the device could impact the target at such an oblique angle that the range sensor never effectively senses the target until it is too close to effectively deploy the second electrode. Alternatively, if the device is fired in a direction where the projectile must pass close by an obstacle en route to the target, the range sensor might detect an object next to its trajectory and prematurely fire the second electrode, causing the second electrode to miss the target.

An array of electrodes tethered together has been described in U.S. Pat. No. 5,698,815 to Ragner. Such arrays, when in flight, are inherently aerodynamically unstable. Accuracy of hitting a target with such an array is less than with other technologies discussed above.

Without systems and methods of the present invention, further improvements in cost, reliability, range, and effectiveness cannot be realized for energy weapons. Applications for energy weapons will remain limited, hampering law enforcement and failing to provide increased self defense to individuals.

SUMMARY OF THE INVENTION

A device for impact with a target, according to various aspects of the present invention, includes a first electrode, a second electrode, an apparatus for restraining movement of the second electrode with respect to the first electrode; and an apparatus for removing restraint of the second electrode with respect to the first electrode after the first electrode makes contact with the target. In operation, the second electrode initially moves away from the target to make contact with the target a distance away from where the first electrode made contact with the target.

A method, according to various aspects of the present invention, is performed by a projectile that includes a first electrode, a second electrode, and an electrode deployment apparatus that deploys the second electrode. The method includes: (a) restraining movement of the second electrode with respect to the first electrode; and (b) removing restraint of the second electrode with respect to the first electrode after the first electrode makes contact with the target. The second electrode initially moves away from the target to make contact with the target a distance away from where the first electrode made contact with the target.

BRIEF DESCRIPTION OF THE DRAWING

Embodiments of the present invention will now be further described with reference to the drawing, wherein like designations denote like elements, and.

Figure 1:
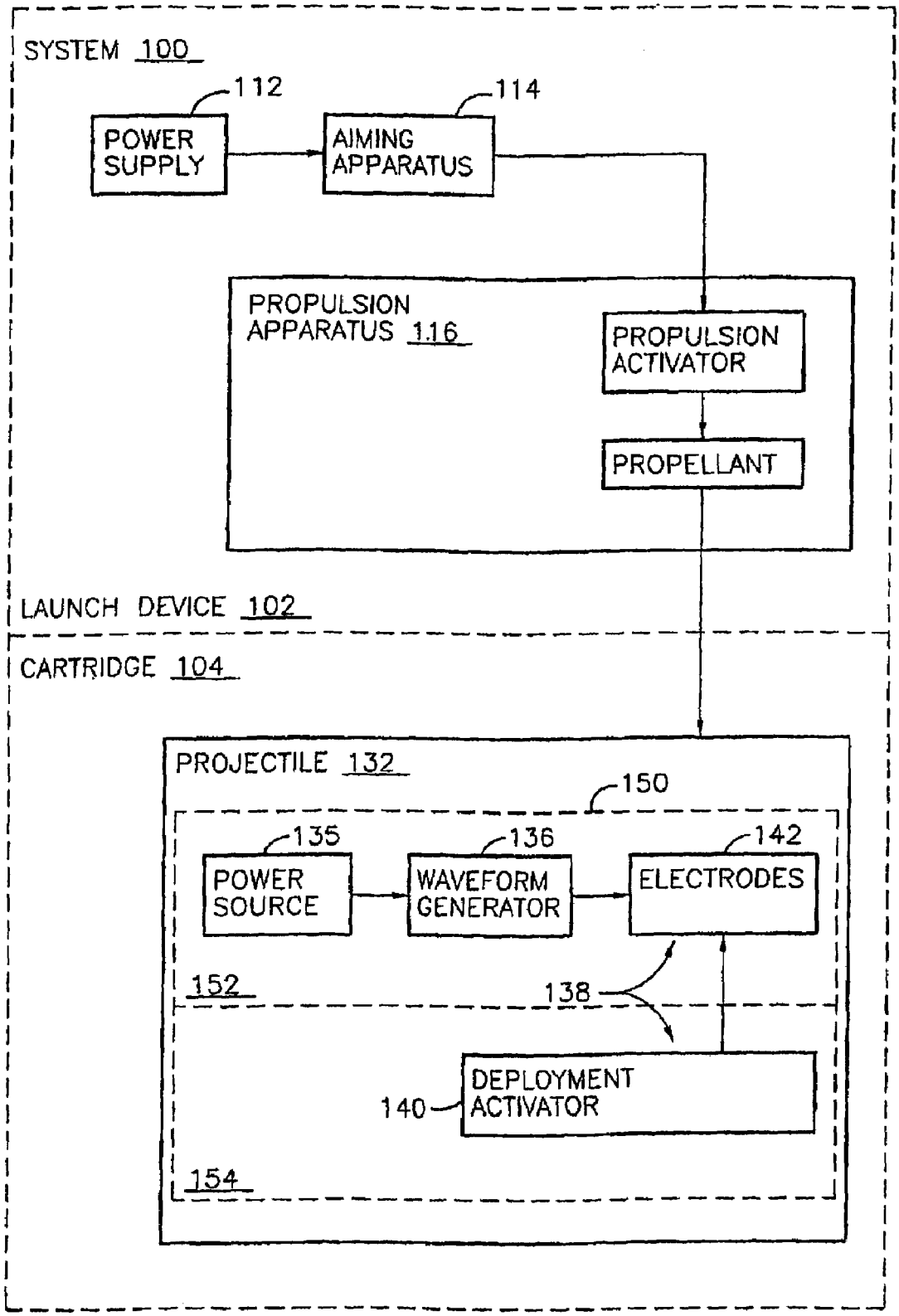
FIG. 1 is a functional block diagram of a system that uses an electrified projectile according to various aspects of the present invention.
Figure 3:
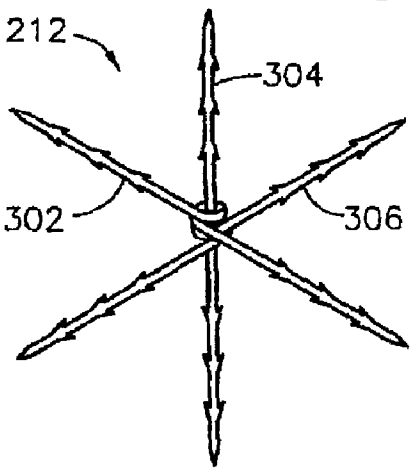
FIG. 3 is a perspective view of an electrode carried in the projectile of FIG. 2.

A person of ordinary skill in the art will recognize that portions of the drawing are shown not to scale for clarity of presentation.

DETAILED DESCRIPTION OF THE INVENTION

A system according to various aspects of the present invention delivers a stimulus signal to an animal (e.g., a human) to immobilize the animal. Immobilization is suitably temporary, for example, to remove the animal from danger or to thwart actions by the animal such as for applying more permanent restraints on mobility. Electrodes may come into contact with the animal by the animal's own action (e.g., motion of the animal toward an electrode), by propelling the electrode toward the animal (e.g., electrodes being part of an electrified projectile), by deployment mechanisms, and/or by gravity. For example, system 100 of FIGS. 1-9 includes launch device 102 and cartridge 104. Launch device 104 includes power supply 112, aiming apparatus 114, and propulsion apparatus 116. Propulsion apparatus 116 includes propulsion activator 118 and propellant 120. In an alternate implementation, propellant 120 is part of cartridge 104.

Any conventional materials and technology may be employed in the manufacture and operation of launch device 104. For example, power supply 112 may include one or more rechargeable batteries, aiming apparatus 114 may include a laser gun sight, propulsion activator 118 may include a mechanical trigger similar in some respects to the trigger of a hand gun, and propellant 120 may include compressed nitrogen gas. In operation, cartridge 104 is mounted on or in launch device 104, manual operation by the user causes a projectile bearing electrodes to be propelled away from launch device 104 and toward a target (e.g., an animal such as a human), and after the electrodes become electrically coupled to the target, a stimulus signal is delivered through a portion of the tissue of the target. In one implementation, launch device is handheld and operable in a manner similar to a conventional hand gun.

Cartridge 104 includes projectile 132 having power source 134, waveform generator 136, and electrode deployment apparatus 138. Electrode deployment apparatus 138 includes deployment activator 140 and one or more electrodes 142. Power source 134 may include any conventional battery selected for relatively high energy capacity to volume ratio. Waveform generator 136 receives power from power source 134 and generates a conventional stimulus signal using conventional circuitry.

The stimulus signal is delivered into a circuit that is completed by a path through the target via electrodes. Power source 134, waveform generator 136, electrodes 142 cooperate to form a stimulus signal delivery circuit that may further include one or more additional electrodes not deployed by deployment activator 142 (e.g., placed by impact of projectile 132).

Projectile 132 may include a body having compartments or other structures for mounting power source 134, a circuit assembly for waveform generator 136, and electrode deployment apparatus 138. The body may be formed in a conventional shape for ballistics (e.g., a wetted aerodynamic form).

An electrode deployment apparatus includes any mechanism that moves electrodes from a stowed configuration to a deployed configuration. For example, in an implementation where electrodes 142 are part of a projectile propelled through the atmosphere to the target, a stowed configuration provides aerodynamic stability for accurate travel of the projectile. A deployed configuration completes a stimulus signal delivery circuit directly via impaling the tissue or indirectly via an arc into the tissue. A separation of about 7 inches has been found to be more effective than a separation of about 1.5 inches; and, longer separations may also be suitable such as an electrode in the thigh and another in the hand. When the electrodes are further apart, the stimulus signal apparently passes through more tissue, creating more effective stimulation.

According to various aspects of the present invention, deployment of electrodes is activated after contact is made by projectile 132 and the target. Contact may be determined by a change in orientation of the deployment activator; a change in position of the deployment activator with respect to the projectile body; a change in direction, velocity, or acceleration of the deployment activator; and/or a change in conductivity between electrodes (e.g., 142 or electrodes placed by impact of projectile 132 with the target). A deployment activator 140 that detects impact by mechanical characteristics and deploys electrodes by the release or redirection of mechanical energy is preferred for low cost projectiles.

Deployment of electrodes, according to various aspects of the present invention, may be facilitated by behavior of the target. For example, one or more closely spaced electrodes at the front of the projectile may attach to a target to excite a painful reaction in the target. One or more electrodes may be exposed and suitably directed (e.g., away from the target). Exposure may be either during flight or after impact. Pain in the target may be caused by the barb of the electrode stuck into the target's flesh or, if there are two closely spaced electrodes, delivery of a stimulus signal between the closely spaced electrodes. While these electrodes may be too close together for suitable immobilization, the stimulus signal may create sufficient pain and disorientation. A typical response behavior to pain is to grab at the perceived cause of pain with the hands (or mouth, in the case of an animal) in an attempt to remove the electrodes. This so called "hand trap" approach uses this typical response behavior to implant the one or more exposed electrodes into the hand (or mouth) of the target. By grabbing at the projectile, the one or more exposed electrodes impale the target's hand (or mouth). The exposed electrodes in the hand (or mouth) of the target are generally well spaced apart from other electrodes so that stimulation between an other electrode and an exposed electrode may allow suitable immobilization.

In human testing, it was found that the hands of a target are a particularly effective location for stimulation due to the very high nerve densities within the hand. This nerve density places a large number of nerve fibers close to the maximum charge densities around the exposed electrode, magnifying the total neurostimulation effect.

In an alternate system implementation, launch device 102, cartridge 104, and projectile 132 are omitted; and power source 134, waveform generator 136, and electrode deployment apparatus 138 are formed as an immobilization device 150 adapted for other conventional forms of placement on or in the vicinity of the target. In an alternate implementation deployment apparatus 138 is omitted and electrodes 142 are placed by target behavior and/or gravity. Immobilization device 150 may be packaged using conventional technology for personal security (e.g., planting in a human target's clothing or in an animals hide for future activation), facility security (e.g., providing time for surveillance cameras, equipment shutdown, or emergency response), or military purposes (e.g., land mine).

Projectile 132 may be lethal or non-lethal. In alternate implementations, projectile 132 includes any conventional technology for administering deadly force.

Immobilization as discussed herein includes any restraint of voluntary motion by the target. For example, immobilization may include causing pain or interfering with normal muscle function. Immobilization need not include all motion or all muscles of the target. Preferably, involuntary muscle functions (e.g., for circulation and respiration) are not disturbed. In variations where placement of electrodes is regional, loss of function of one or more skeletal muscles accomplishes suitable immobilization. In another implementation, suitable intensity of pain is caused to upset the target's ability to complete a motor task, thereby incapacitating and disabling the target.

Alternate implementations of launch device 102 may include or substitute conventionally available weapons (e.g., firearms, grenade launchers, vehicle mounted artillery). Projectile 132 may be delivered via an explosive charge 120 (e.g., gunpowder, black powder). Projectile 132 may alternatively be propelled via a discharge of compressed gas (e.g., nitrogen or carbon dioxide) and/or a rapid release of pressure (e.g., spring force, or force created by a chemical reaction such as a reaction of the type used in automobile air-bag deployment).

Projectile 132 may be tethered to launch device 102 and suitable circuitry in launch device 102 (not shown) using any conventional technology for purposes of providing substitute or auxiliary power to power source 134; triggering, retriggering, or controlling waveform generator 136; activating, reactivating, or controlling deployment; and/or receiving signals at launch device 102 provided from electrodes 142 in cooperation with instrumentation in projectile 132 (not shown).

Projectiles 132 for use in system 100 may be of one or more of several implementations. In each implementation, the deployment activators and electrodes discussed below may be combined in any manner to produce a projectile suitable for one or more purposes of system 100 discussed above. By combining deployment activation techniques and electrode mechanical features of the various implementations discussed below, the likelihood of success is increased for placing two electrodes at a sufficient distance apart from each other for immobilization.

Figure 2B:
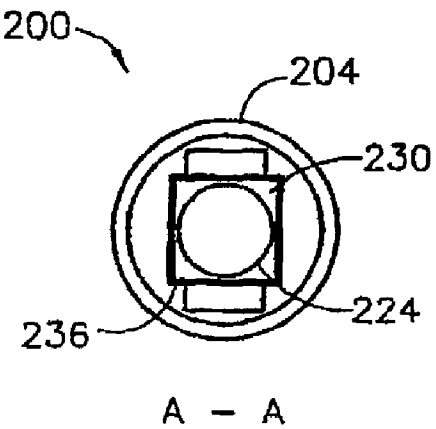
FIG. 2B is a cross sectional view of the projectile of FIG. 2A at the plane A-A identified in FIG. 2A.
Figure 2A:
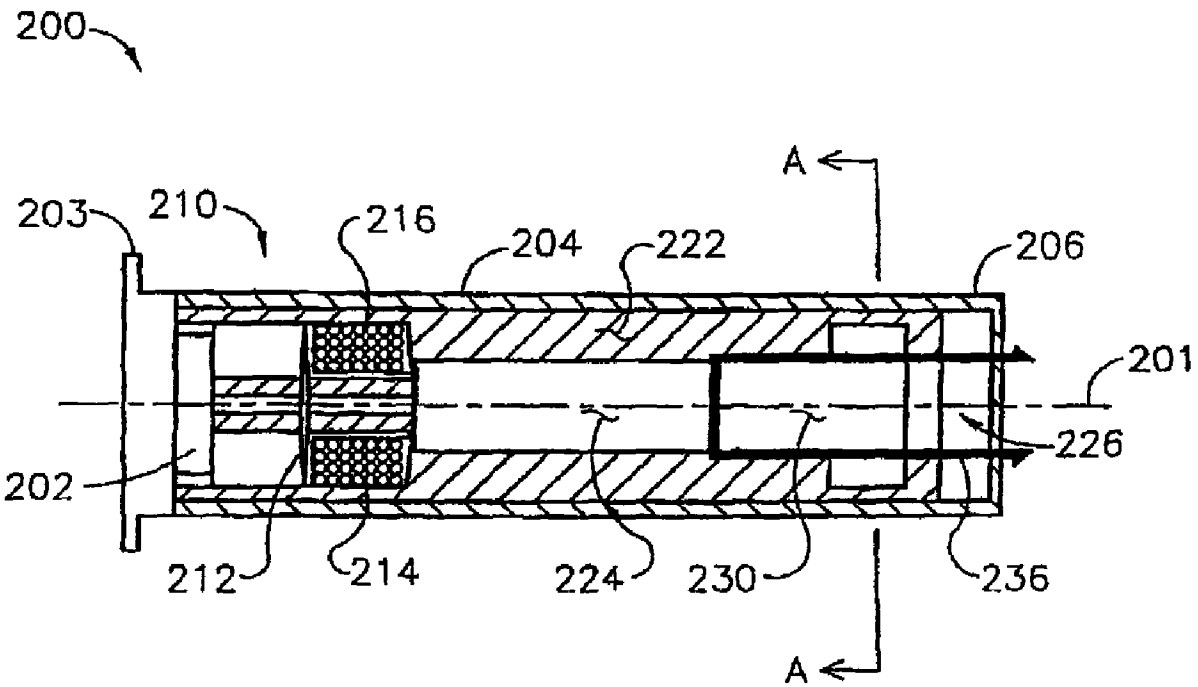
FIG. 2A is a cross sectional side view of a projectile in a stowed configuration for use in the system of FIG. 1.
Figure 2D:
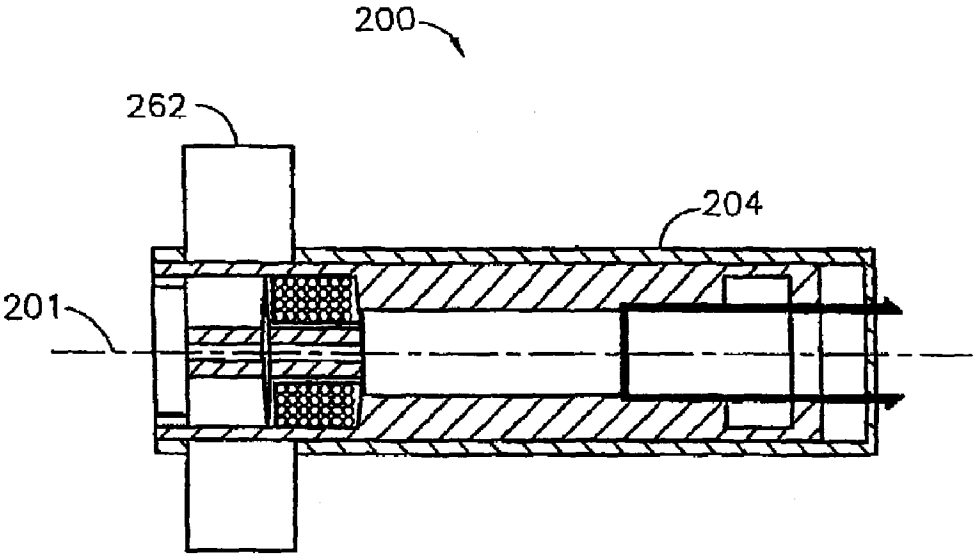
FIG. 2D is a cross sectional side view of the projectile of FIG. 2C.
Figure 2C:
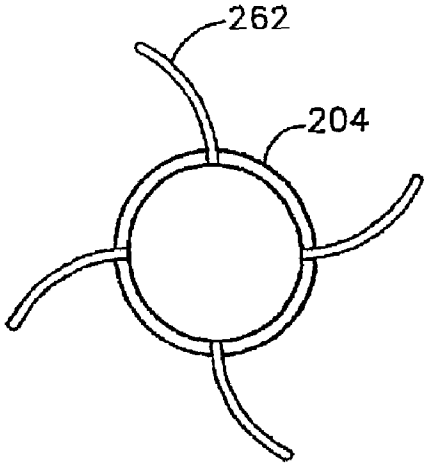
FIG. 2C is a rear end view of the projectile of FIG. 2A in an in flight configuration.
Figure 4B:
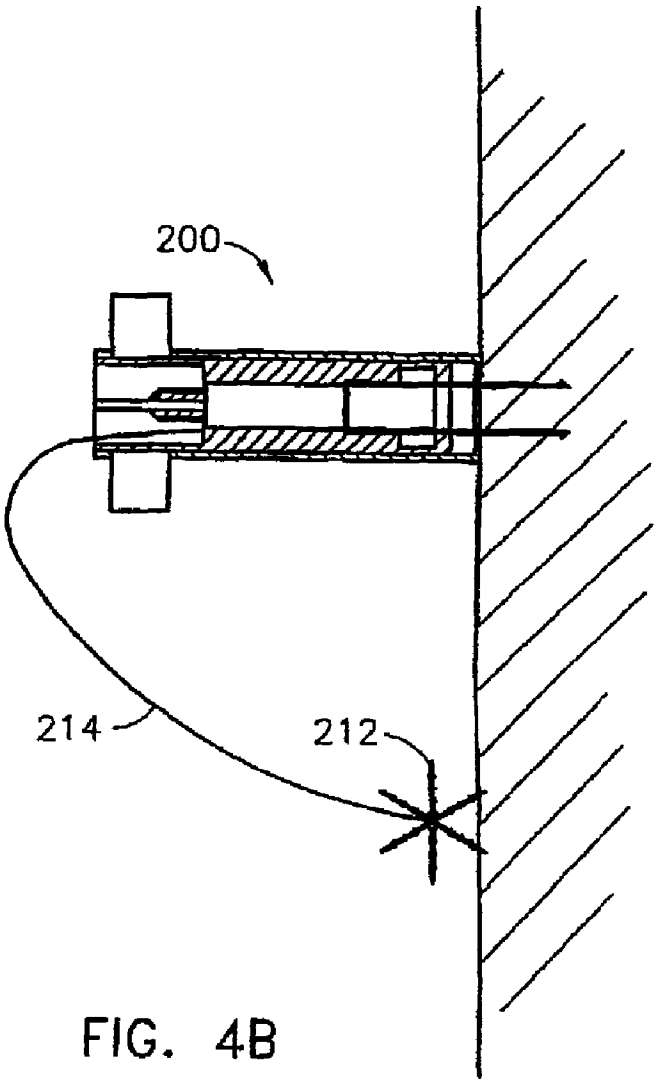
FIG. 4B is a cross sectional view of the projectile of FIG. 2 after deployment of electrodes.
Figure 4A:
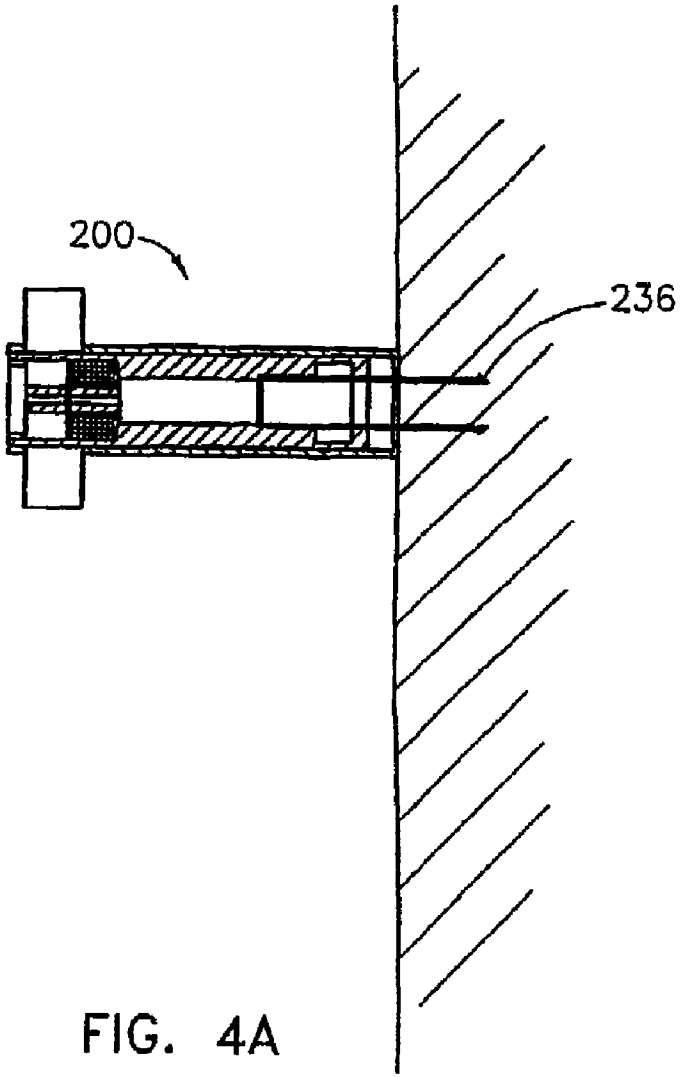
FIG. 4A is a cross sectional view of the projectile of FIG. 2 in contact with a target.

A projectile, according to various aspects of the present invention, deploys an electrode from the rear of the projectile after impact of the projectile and the target. For example, a projectile 200 of FIGS. 2-4 has four configurations: (1) a stowed configuration (FIG. 2A), where fins and electrodes are in storage locations and orientations; (2) an in flight configuration (FIG. 2C); (3) an impact configuration after contact with the target (FIG. 4A); and (4) an electrode deployed configuration (FIG. 4B). Projectile 200 includes plug 202 attached (e.g., close fitted, formed, crimped, or sealed) to body 204. Forward force against plug 202 propels projectile 200 forward. Body 204 includes casing 206, electrode pod 210, translating element 222, battery 224, and circuit assembly 230.

Plug 202 may include propellant 120 (e.g., 3 to 4 grains of gunpowder for a 30 gram projectile). In another implementation, propellant 120 in launch device 102 or projectile 132 includes a 40 mm grenade shell. Projectile 200 may include a mechanical shock absorbing tip (not shown) such as foam rubber or the like. In yet another implementation, plug 202 or launch device 102 includes a self-contained pressurized gas charge that propels projectile 200 when the pressurized gas is released. As discussed below, propellant is omitted from plug 202 and is contained in launch device 102.

Casing 206 provides an aerodynamic housing for components of projectile 200 and cooperates with translating element 222. Casing may support one or more fins 262 for improving its flight characteristics. An alternate implementation omits fins 262 for reduced cost. In one implementation casing 206 is made of a polymer such as NORYL® or ABS plastic and is shaped and/or dimensioned in a suitable fashion to be delivered by the desired launch device. Fins 262 may also be made of plastic and may include copper or steel springs and/or pins for causing movement toward or retaining the deployed position. Fins may provide drag for stabilization of the flight.

Translating element 222 slides within casing 206 to force plug 202 to separate from casing 206 and to fly away from body 204 on impact of projectile 200 with the target. Translating element 222 on impact may be carried toward the front end of projectile 200; and may bounce back toward the rear end of projectile 200. Either translation may release plug 202, preferably the rearward translation. By separating plug 202 from casing 206, electrode pod 210 is activated for deploying electrode 212.

Electrode pod 210 includes electrode 212, tether 214 (e.g., spooled, balled, or packed insulated wire), and spring 216. Tether 214 electrically connects electrode 212 for cooperation in a stimulus signal delivery circuit as discussed above. During deployment, tether 214 extends from storage in pod 210 to a length (e.g., about 5 to 18 inches) that assures suitable electrode spacing between deployable electrode(s) 212 and electrode(s) 236. Tether may include elastic material to improve the force of impact between electrode 212 and the target. Spring 216 is compressed into pod 210 and in mechanical communication with plug 202 on assembly of projectile 200. When plug 202 is separated from casing 206, spring 216 urges electrode 212 and tether 214 to deploy out of casing 206 to impact the target at a point at a distance from electrodes 236.

Battery 224 provides power source 134 for circuit assembly 230. In alternate implementations, battery 224 is replaced with a capacitor having a charge maintained by power supply 112 in launch device 102 or by a power supply (not shown) in cartridge 104. Battery 224 may include one or more conventional cells. In one implementation battery 224 is a conventional 1.5 volt (nominal) cell in a AAAA standard sized package. Battery 224 may be fixed to case 206 or to translating element 222 in any conventional manner. The mass of battery 224 when fixed to translating element 222 adds to the inertia of translating element 222 for more efficient separating of plug 202 from casing 206.

Circuit assembly 230 may be a flexible circuit assembly wrapped about battery 224. Circuit assembly 230 implements waveform generator 136 and supports electrodes 236. Circuit assembly 230 is connected to battery 224 in any conventional manner. Electrodes 236 may be constructed of stainless steel and include barbs for being retained in the target after contact with the target. Movement of translating element 222 in a forward direction after impact may urge electrodes 236 forward to assure burying electrodes 236 into the target.

A deployable electrode, according to various aspects of the present invention, is adapted for tethered deployment and impact with the target as discussed above. Electrodes 212 may be formed of stainless steel in any conventional manner. For example, electrode 212 of FIG. 3 includes 6 spikes on 3 mutually orthogonal axes. Spikes have sharp tips for penetration of fabric and tissue and rearward facing barbs to deter removal from the target.

Projectile 200 maintains its stowed configuration while in cartridge 104. At a suitable distance from launch device 102, fins 262 move away from casing 206 to put projectile 200 in the in flight configuration. Translating element 222 is forced rearward during flight. Inpact with the target (FIG. 4A) causes projectile 200 to conform to the impact configuration wherein electrodes 236 are deployed into the target and translating element 222 bounces rearward to dislodge plug 202. After plug 202 separates from casing 206, electrode 212 swings and/or bounces erratically on tether 214. After electrode 212 contacts the target, projectile 200 is in its fully deployed configuration (FIG. 4B) and delivery of the stimulus signal may begin.

Figure 5A:
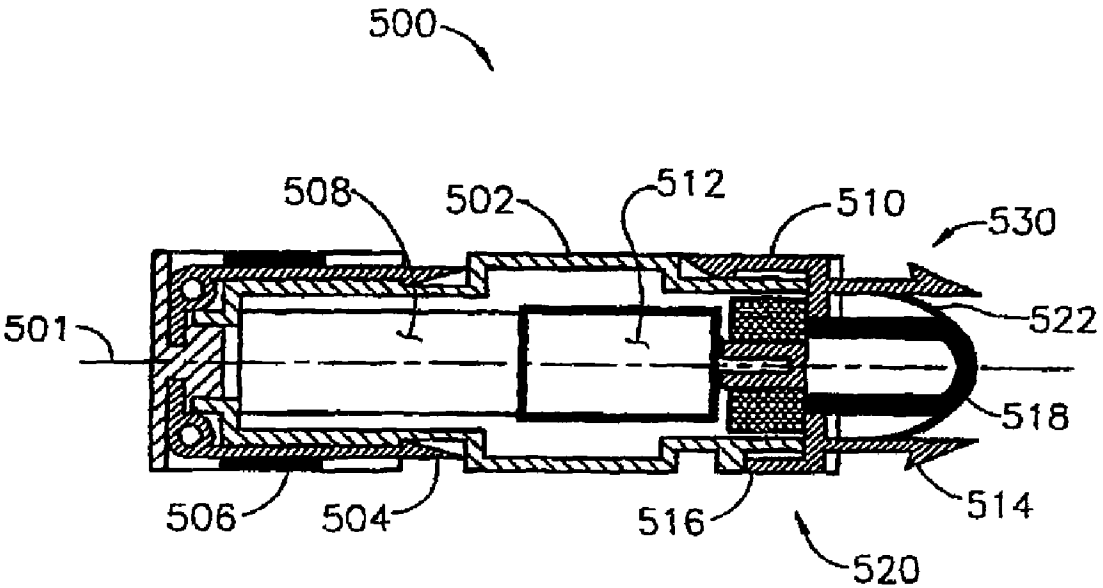
FIG. 5A is a cross sectional side view a projectile in a stowed configuration for use in the system of FIG. 1.
Figure 5B:
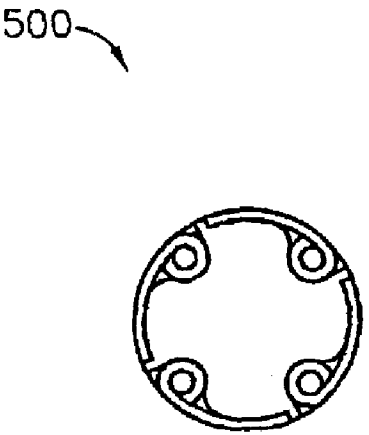
FIG. 5B is a plan view of fin mounting hinges of the projectile of FIG. 5A.
Figure 5D:
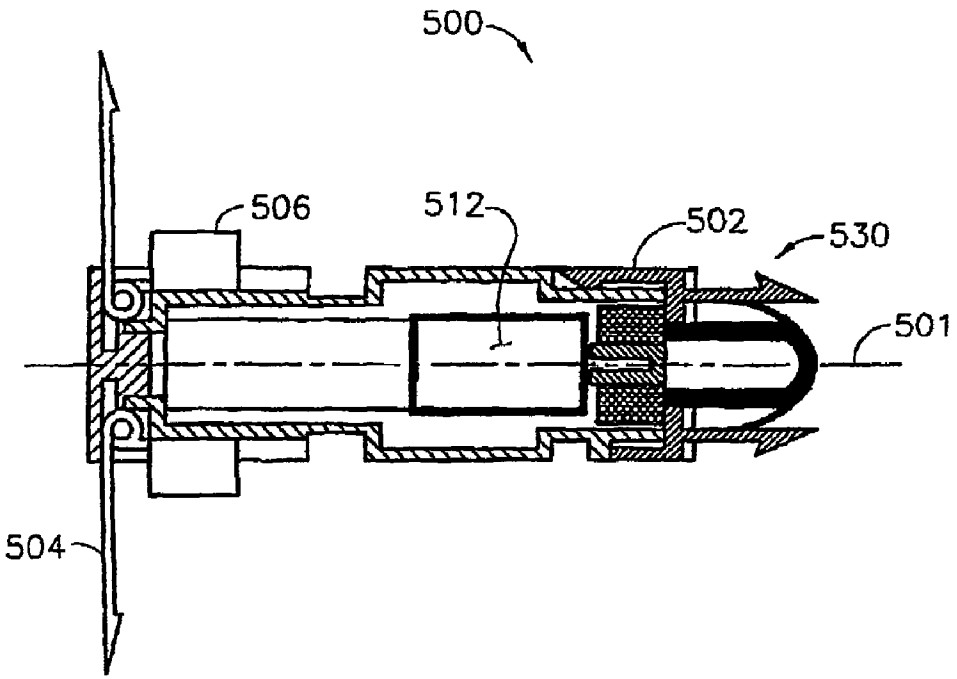
FIG. 5D is a cross sectional side view of the projectile of FIG. 5D.
Figure 5C:
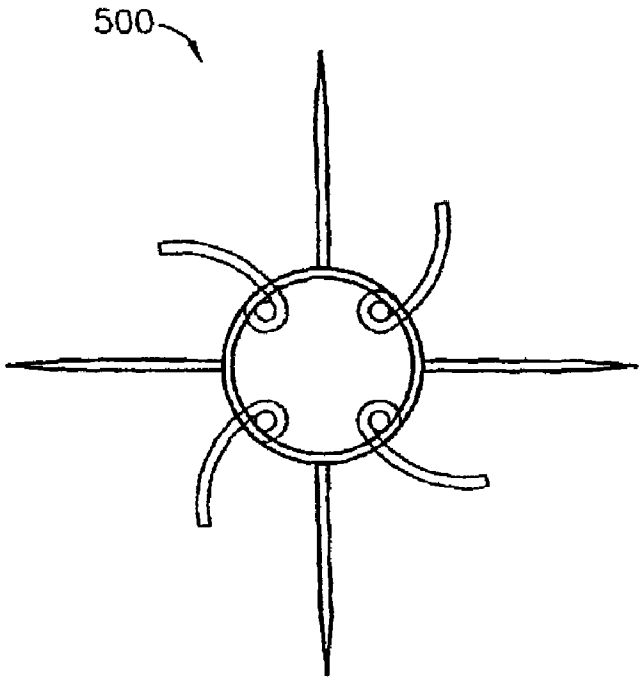
FIG. 5C is a rear end view of the projectile of FIG. 5A in an in flight configuration.
Figure 6B:
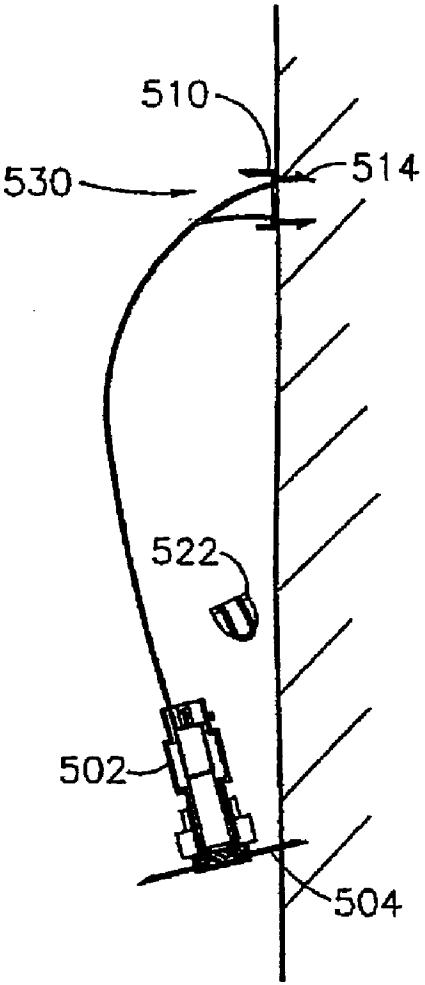
FIG. 6B is a cross sectional side view of the projectile of FIG. 5 after deployment of electrodes.
Figure 6A:
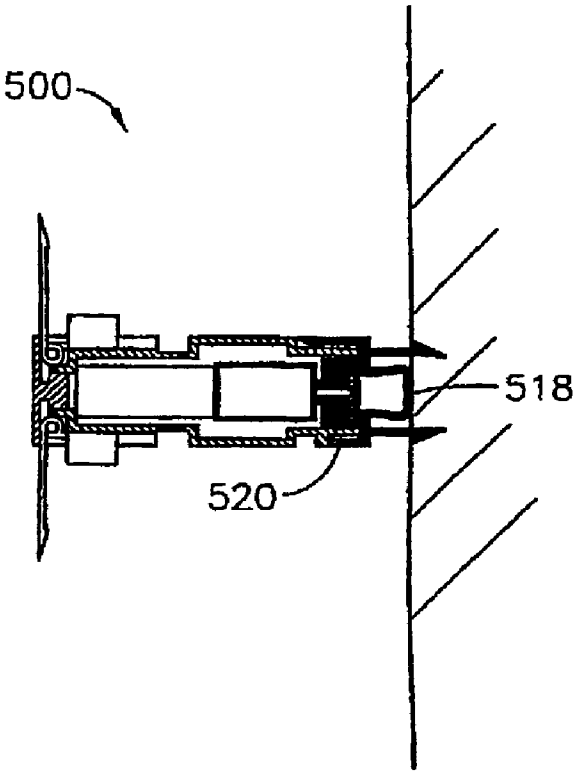
FIG. 6A is a cross sectional side view of the projectile of FIG. 5 in contact with a target.

As a second example, a projectile according to various aspects of the present invention attaches at least one electrode by force of impact of the projectile against the target and attaches at least a second electrode by releasing the second electrode accompanied by a substantial portion of the mass of the entire projectile. For example, projectile 500 of FIGS. 5-6 has four configurations: (1) a stowed configuration (FIGS. 5A-5B), where fins and electrodes are in storage locations and orientations; (2) an in flight configuration (FIGS. 5C and 5D); (3) an impact configuration after contact with the target (FIG. 6A); and (4) an electrode deployed configuration (FIG. 6B). Projectile 500 includes casing 502, four rear electrodes 504, four fins 506, battery 508, rear facing electrode 510, circuit assembly 512, front electrodes 514, electrode tether 516, cap release 518, and cap 522.

Casing 502 provides an aerodynamic housing for components of projectile 500. Casing 502 may support one or more fins 506 for improving its flight characteristics. An alternate implementation omits fins 506 for reduced cost. In one implementation casing 502 is made of a polymer such as NORYL® or ABS plastic and is shaped and/or dimensioned in a suitable fashion to be delivered by the desired launch device. Fins 506 may also be made of plastic and may include copper or steel springs and/or pins for causing movement toward or retaining the deployed position. Fins may provide drag for stabilization of the flight.

Rear electrodes 504 are positioned away from casing 502 in flight by spring force.

Battery 508 provides power source 134 for circuit assembly 512. Battery 508 may include one or more conventional cells. In one implementation battery 508 is a conventional 1.5 volt (nominal) cell in a AAAA standard sized package. Battery 508 may be fixed to casing 502 in any conventional manner. The mass of battery 508 adds to the inertia of casing 502 for more effective impact of rear electrodes with the target.

Front electrode assembly 530 includes rear facing electrode 510, front electrodes 514, and break-away tabs 520. Front electrode assembly 530 is fixed to casing 502 when projectile 500 is mounted in cartridge 104; and, is released after impact of projectile 500 with the target. In one implementation, break-away tabs 520 fix assembly 530 to casing 502. Rear facing electrode 510 is intended to impale a target's hand as the target reaches toward front electrode assembly 530 for instance intending to remove front electrodes 514 from contact with the target.

Circuit assembly 512 performs functions analogous to circuit assembly 230 discussed above.

Electrode tether 516 electrically connects front electrodes 514 and rear facing electrode 510 for cooperation in a stimulus signal delivery circuit as discussed above. Two or more conductors in tether 516 supply a stimulus signal from waveform generator 136 of circuit assembly 512 to: (a) front electrodes and/or to (b) rear facing electrode 510. During deployment, tether 516 extends from storage in casing 502 to a length (e.g., about 5 to 18 inches) that assures suitable electrode spacing between deployable rear electrodes 504 and front electrodes 514. Tether 516 may include elastic material to improve the force of impact between rear electrodes 504 and the target.

A cap release is a deformable (e.g., rubber) element that when crushed on impact imparts a separating force between a front electrode assembly and the remainder of a projectile. For example, on impact, cap release 518 compresses along axis 501 to release casing 502 from front electrode assembly 530. In one implementation, inertia of casing 502 and/or battery 508 work against cap release 518 and/or cap 522 to fracture break-away tabs 520. Cap release 518 and/or cap 522 may store compression energy later released into casing 502 to urge casing 502 away from front electrode assembly 530, deploying tether 516 out of casing 502. At least one rear electrode 504 then makes contact with the target at a point at a distance from front electrodes 514.

An alternate implementation of projectile 500 includes a translating ring. On impact, the translating ring slides inside casing 502 and along axis 501 to force deployment of rear electrodes 504 that remain stowed until after impact. Such a translating ring may urge front electrodes into the target.

In operation of tethers 214 and 513, the tethered object (212 or 502) may fall by gravity and/or move away from the target by rebound energy. As the object reaches the end of the tether, it may fall back toward the target, much like a pendulum. An elastic tether may further enhance the approach of the object to the target. An elastic tether stores energy as it stretches, returning this energy into the object as it contracts, accelerating the object toward the target, and increasing the likelihood of an effective penetration of clothing and/or skin of the target. A distance between the front electrode(s) and the rear electrode(s) of 12 to 24 inches is preferred.

In other implementations of projectile 200 or 500, a secondary propellant or mechanism propels the tethered object erratically until impact with the target. The secondary propellant or mechanism may include a small rocket motor.

Figures 7A, 7B, 7C:
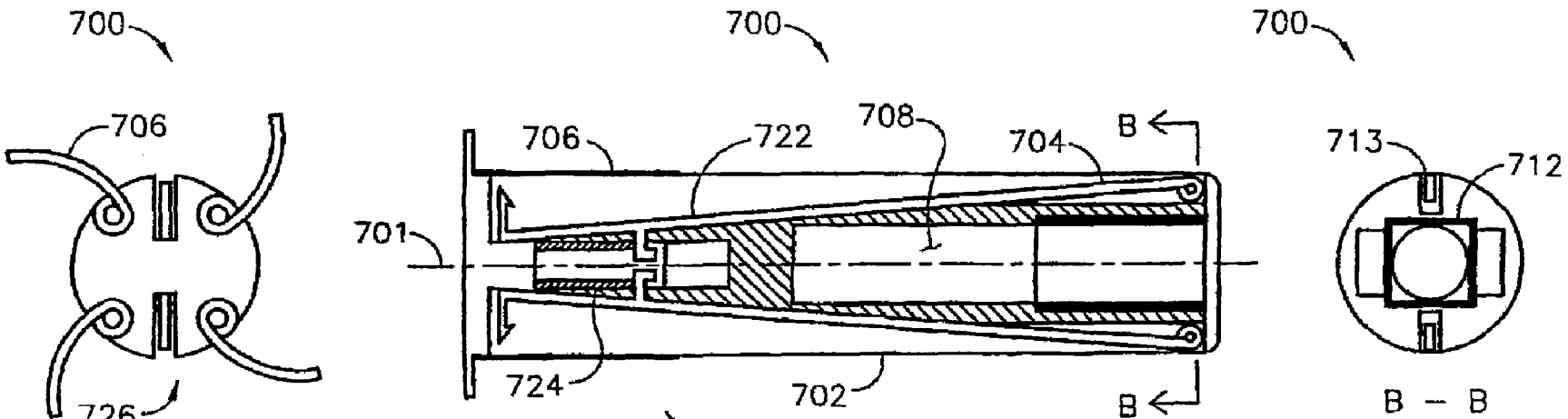
FIG. 7A is a rear end view of a projectile in an in flight configuration for use in the system of FIG. 1.
FIG. 7B is a cross sectional side view of the projectile of FIG. 7A.
FIG. 7C is a cross sectional view of the projectile of FIG. 7A at the plane B-B identified in FIG. 7B.
Figure 8:
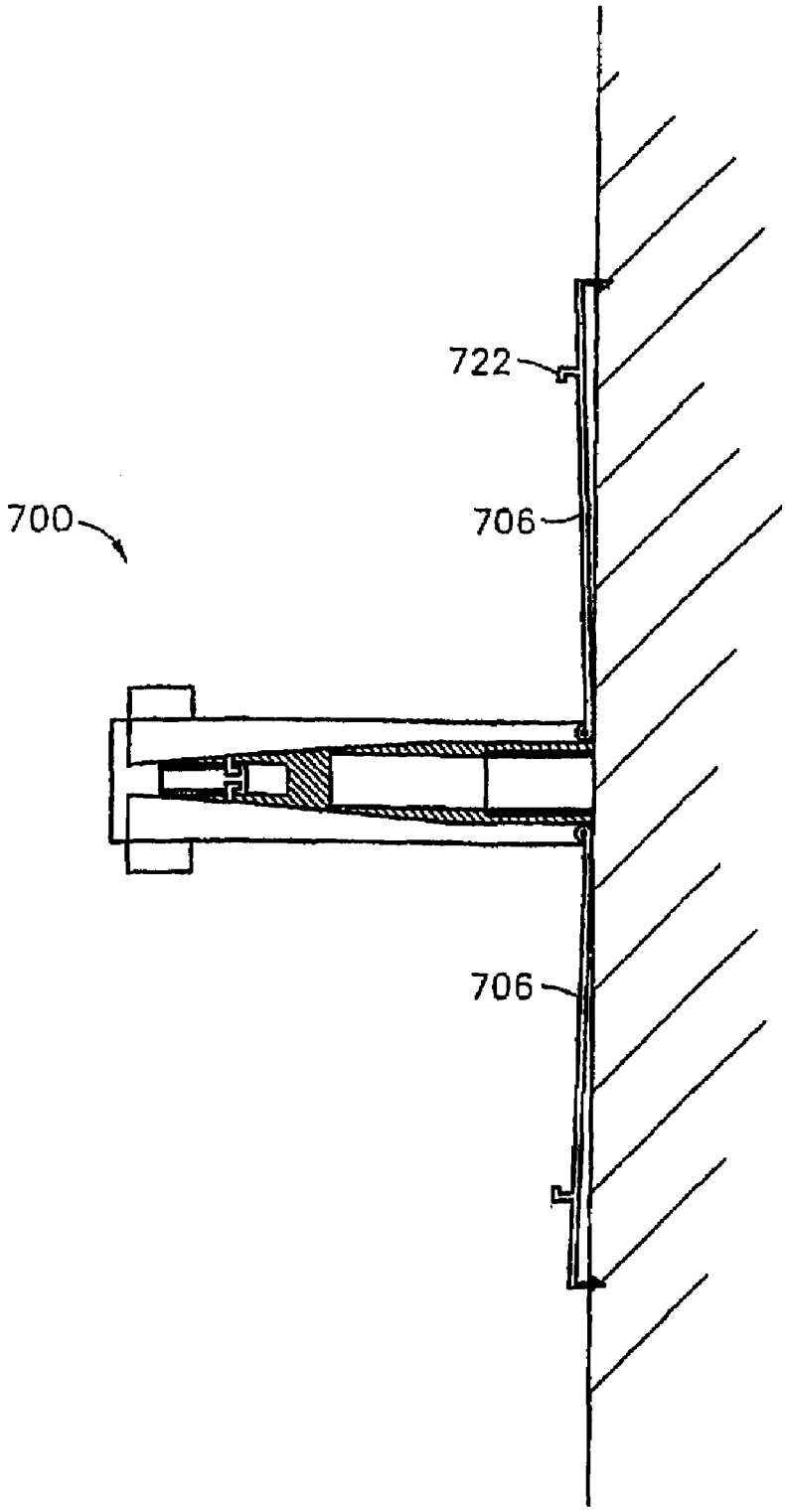
FIG. 8 is a cross sectional side view of the projectile of FIG. 7 after deployment of electrodes.

As a third example, a projectile according to various aspects of the present invention includes one or more deployable electrode arms each having one or more barbs. In operation, upon impact of the projectile with the target these arms spring away from the projectile body and attach to the target. For example, projectile 700 of FIGS. 7-8 has four configurations: (1) a stowed configuration (FIGS. 7B and 7C), where fins and electrodes are in storage locations and orientations; (2) an in flight configuration (FIGS. 7A and 7C); (3) an impact configuration after contact with the target (analogous to FIG. 4A); and (4) an electrode deployed configuration (FIG. 8). Projectile 700 includes casing 702, four front electrodes 704, four fins 706, battery 708, circuit assembly 712, and release 710.

Casing 702 provides an aerodynamic housing for components of projectile 700. Casing 702 may support one or more fins 706 for improving its flight characteristics. An alternate implementation omits fins 706 for reduced cost. In one implementation casing 702 is made of a polymer such as NORYL® or ABS plastic and is shaped and/or dimensioned in a suitable fashion to be delivered by the desired launch device. Fins 706 may also be made of plastic and may include copper or steel springs and/or pins for causing movement toward or retaining the deployed position. Fins may provide drag for stabilization of the flight.

Battery 708 and circuit assembly 712 operate in a manner analogous to battery 508 and circuit assembly 512 discussed above.

Four front electrodes 704 are deployed after impact when released by release 710. After impact of projectile 700 and the target, release 710 releases a tab (not shown) on each electrode 704. In one implementation, release 710 includes a containment ring (not shown) that slides forward at the sudden deceleration of projectile 700. Translation of this ring releases each tab to permit each electrode to follow an arc away from axis 701 to a deployed position at or in front of the point of contact between projectile 700 and the target (depending on the shape of the surface around that point).

Each electrode 704 may be urged along the arc by a torsion spring in each hinge 713. Electrodes 704 may be stowed in slots 726 formed in casing 702 along a length of projectile 700. When stowed, each torsion spring is compressed. The potential energy of the compressed torsion spring provides a propellant by which the electrodes 704 are forced out of slots 726 and into the target.

Release 710 may include a hook 722 on each electrode and a slotted cylinder 724 that translates along axis 701 inside casing 702. Electrodes are retained when each hook 722 is in frictional contact with the slotted cylinder. Slotted cylinder 724 is forced rearward by the inertia of a projectile discharge from launch device 102 assuring frictional contact with hooks 722. After impact with the target, slotted cylinder 724 slides forward and releases each hook 722, deploying electrodes 704 as discussed above.

In an alternate implementation of projectile 700, two of the four electrodes 704 are omitted. In a further alternate implementation, more than four electrodes are implemented symmetrically about axis 701. In addition, front electrodes of the type described above with reference to 236 and 514 are included in alternate projectiles having fixed mounting or spring-loaded mounting in the front of the projectile.

A rear facing electrode may be added to any of projectiles 200, 700, and alternates of each discussed above.

Deployment, according to various aspects of the present invention may use the forward momentum of the projectile to propel electrodes into contact with the target. For example, in one implementation a primary projectile carries several secondary projectiles. The forward momentum of the secondary projectiles after impact with the target may cause the secondary projectiles to deploy into the target.

Secondary projectiles may be positioned in the rear portion of the primary projectile and housed in bores at an angle, (e.g., 45 degrees) to the axis of projectile flight. The configuration of the bores and the forward momentum vector forces each secondary projectile to deploy at the angle of the bore toward the target. Electrodes deployed in any manner from the secondary projectiles contact the target away from the one or more front electrodes of the primary projectile. Each secondary projectile or electrode may be tethered by a conductive wire to the primary or secondary projectile for delivering a stimulus signal.

A propellant may also be used to propel the secondary projectiles or electrodes from within their respective bores. For example, the primary projectile may include a pressurized gas or explosive charge which is activated after impact with the target. The propellant ejects each secondary projectile from its stowed location into the target.

Figure 9A:
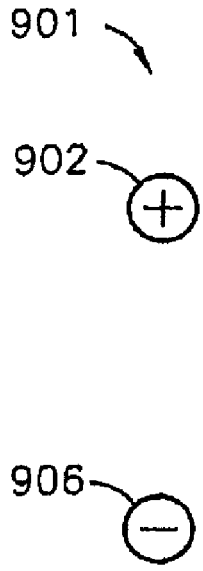
FIG. 9A is a plan view of points on a target after impact and deployment of electrodes of a projectile according to various aspects of the present invention.
Figure 9B:
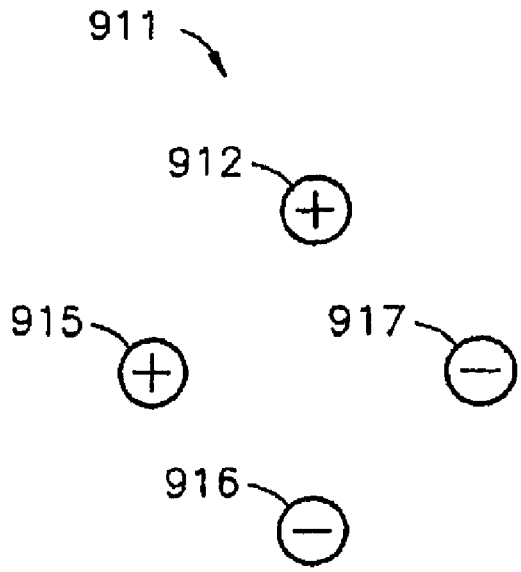
FIG. 9B is a plan view of points on a target after impact and deployment of electrodes of a projectile according to various aspects of the present invention.

A method for increasing the effective spread between electrodes in contact with the target includes deploying multiple electrodes in one or more clusters or arrays. Multiple electrodes may have closer spacing to the point of projectile impact while still delivering the electrical charge to a greater surface area. For instance, muscular contractions were measured from two different configurations 901 and 911 as shown in FIGS. 9A and 9B. In configuration 901, electrodes 902 and 906 were spaced four inches apart. Electrode 902 was connected to the positive terminal of a stimulation power supply. Electrode 906 was connected to the negative terminal of the power supply. In configuration 911, four electrodes were used. Electrode 912 was four inches from electrode 916; and electrode 915 was four inches from electrode 917. Electrodes 912, 917, 916, and 915 formed a square centered about point 914. Points 904 and 914 may approximate the point of impact of a projectile. In other deployments the point of impact of the projectile is not material. Test results indicated configuration 911 was about 5% less effective (generated about 5% less muscle contraction) than configuration 901. It is believed that the lower effectiveness was the result of lower charge densities. While the greater number of electrodes delivered the charge to a greater total surface area, the total charge at each electrode was roughly cut in half, lowering the charge densities at the electrodes, and lowering the charge densities in the various current pathways through the body. This lower charge density resulted in fewer neurons being stimulated, and a lesser muscular response.

In any of the deployed electrode configurations discussed above, the stimulation signal may be switched between various electrodes so that not all electrodes are active at any particular time. Accordingly, a method for applying a stimulus signal to a plurality of electrodes includes, in any order: (a) selecting a pair of electrodes; (b) applying the stimulus signal to the selected pair; (c) monitoring the charge delivered into the target; (d) if the delivered charge is less than a limit, conclude that at least one of the selected electrodes is not sufficiently coupled to the target to form a stimulus signal delivery circuit; and (e) repeating the selecting, applying, and monitoring until a predetermined total charge is delivered. A microprocessor performing such a method may identify suitable electrodes in less than a millisecond such that the time to select the electrodes is not perceived by the target.

The term "after impact" is understood to mean any instant of time after initial physical contact between a projectile and a target. The actions to be accomplished after impact are accomplished so soon after impact as to be perceived by the target as occurring simultaneously with impact.

Unless contrary to physical possibility, the inventor envisions the methods and systems described herein: (i) may be performed in any sequence and/or combination; and (ii) the components of respective embodiments combined in any manner.

Although there have been described preferred embodiments of this novel invention, many variations and modifications are possible and the embodiments described herein are not limited by the specific disclosure above, but rather should be limited only by the scope of the appended claims.

What is claimed is:

1. A device for impact with a target, the device comprising:

a first electrode, a second electrode, and means for deploying the second electrode away from the first electrode, comprising:

(1) means for restraining movement of the second electrode with respect to the first electrode; and (2) means for removing restraint of the second electrode with respect to the first electrode after the first electrode makes contact with the target, so that the second electrode initially moves away from the target to make contact with the target a distance away from where the first electrode made contact with the target.

2. A device for impact with a target, the device comprising:

a first portion comprising a first electrode for contact with the target;

a second portion comprising a second electrode for contact with the target;

a tether that couples the first portion and the second portion; and a coupling that facilitates launching the device as a unit, and that, after the first portion makes contact with the target, releases the second portion from the first portion, so that the second portion moves away from the target, to deploy the second electrode on the tether a distance away from the first electrode.

3. The device of claim 2 wherein the coupling comprises a casing and a translating member that moves with respect to the casing in response to impact of the device and the target to release the second portion from the first portion.

4. The device of claim 2 wherein the coupling comprises a fastener that is defeated in response to impact of the device and the target to release the second portion from the first portion.

5. The device of claim 4 wherein the fastener comprises a break-away tab.

6. The device of claim 2 wherein the coupling comprises a latch that is released in response to impact of the device and the target to release the second portion from the first portion.

7. The device of claim 2 wherein the coupling comprises a propellant that propels the second electrode away from the first electrode.

8. The device of claim 7 wherein the propellant propels the second electrode initially in a direction away from the target.

9. The device of claim 2 wherein the tether exhibits elasticity to effect a forceful impact of the second electrode and the target.

10. The device of claim 2 wherein the second electrode comprises a first barb directed in a first direction, a second barb directed in a second direction, and a third barb directed in a third direction.

11. The device of claim 10 wherein the first direction, second direction, and third direction, are mutually orthogonal.

12. The device of claim 2 wherein the second portion has mass that facilitates impact of the second electrode and the target.

13. The device of claim 2 wherein a total mass of the second portion exceeds a total mass of the first portion.

14. The device of claim 2 wherein the coupling uses an energy of impact of the device and the target to release the second portion from the first portion.

15. The device of claim 2 wherein the coupling redirects a momentum of impact of the device and the target into motion of the second portion away from the first portion.

16. A round comprising the device of claim 2.

17. A method performed by a device comprising a first electrode, a second electrode, and an electrode deployment apparatus that deploys the second electrode, the method comprising:

restraining movement of the second electrode with respect to the first electrode; and removing restraint of the second electrode with respect to the first electrode after the first electrode makes contact with the target, so that the second electrode initially moves away from the target to make contact with the target a distance away from where the first electrode made contact with the target.

18. The method of claim 17 wherein:

the device further comprises a casing and a plug that in a first position restrains the second electrode within the casing from movement with respect to the first electrode; and removing comprises urging the plug away from the first position.

19. The method of claim 18 wherein the electrode deployment apparatus comprises a translating member that translates with respect to the casing to urge the plug away from the first position.

20. The method of claim 17 wherein the removing comprises defeating a fastener.

21. The method of claim 20 wherein defeating the fastener comprises defeating a break-away tab.

22. The method of claim 17 wherein:

the device further comprises a casing and a translating member that translates with respect to the casing; and removing comprises translating by the translating member.

23. The method of claim 22 wherein translating releases a latch to remove restraint.

24. The method of claim 17 wherein removing comprises propelling the second electrode away from the first electrode.

25. The method of claim 24 wherein propelling propels the second electrode initially in a direction away from the target.

26. The method of claim 17 wherein the device further comprises a tether that mechanically couples the second electrode and the first electrode, the tether exhibiting elasticity to effect a forceful impact of the second electrode and the target.

27. The method of claim 17 wherein the second electrode comprises a first barb directed in a first direction, a second barb directed in a second direction, and a third barb directed in a third direction.

28. The method of claim 27 wherein the first direction, second direction, and third direction, are mutually orthogonal.

29. The method of claim 17 wherein removing uses an energy of impact of the device and the target.

30. The method of claim 17 wherein removing comprises redirecting a momentum of impact of the device and the target into motion of the second electrode.

31. The method of claim 17 wherein the device is packaged for use as a projectile.

* * * * *

UNITED STATES PATENT AND TRADEMARK OFFICE

CERTIFICATE OF CORRECTION

PATENT NO. : 7,327,549 B2
APPLICATION NO. : 11/457046
DATED : February 5, 2008
INVENTOR(S) : Patrick W. Smith et al.

It is certified that error appears in the above-identified patent and that said Letters Patent is hereby corrected as shown below:

On the title page, item (56), under "Other Publications", in column 2, line 1, delete "Hurnan" and insert -- Human --, therefor.

In column 8, line 29, delete "Inpact" and insert -- Impact --, therefor.

Signed and Sealed this
Fourth Day of October, 2011

David J. Kappos

David J. Kappos
*Director of the United States Patent and Trademark Office*